US009392385B2

(12) United States Patent
Nielsen et al.

(10) Patent No.: US 9,392,385 B2
(45) **Date of Patent: *Jul. 12, 2016**

(54) HEARING AID

(71) Applicant: GN ReSound A/S, Ballerup (DK)

(72) Inventors: Henrik Nielsen, Roskilde (DK); Jan Johansen, Koge (DK)

(73) Assignee: GN ReSound A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/336,863

(22) Filed: Jul. 21, 2014

(65) Prior Publication Data

US 2015/0296316 A1 Oct. 15, 2015

(30) Foreign Application Priority Data

Apr. 10, 2014 (EP) ..... 14164143

(51) Int. Cl.
*H04R 25/00* (2006.01)

(52) U.S. Cl.
CPC ..... *H04R 25/654* (2013.01); *H04R 25/60* (2013.01); *H04R 25/65* (2013.01); *H04R 2225/025* (2013.01)

(58) Field of Classification Search
CPC .... H04R 25/60; H04R 25/604; H04R 25/608; H04R 25/65; H04R 25/652; H04R 25/654; H04R 25/656; H04R 25/658; H04R 2225/021; H04R 2201/023; H04R 2201/025; H04R 2460/17
USPC ..... 381/322, 324, 325, 328, 329, 330; 181/129, 130, 135
See application file for complete search history.

(56) References Cited

U.S. PATENT DOCUMENTS

| | | | |
|---|---|---|---|
| 2,950,357 | A | 8/1960 | Mitchell |
| 2,959,645 | A | 11/1960 | Ladd |
| 3,408,461 | A | 10/1968 | Langford |
| 3,852,540 | A | 12/1974 | Diethelm |
| 4,553,627 | A | 11/1985 | Gastmeier et al. |

(Continued)

FOREIGN PATENT DOCUMENTS

| | | | |
|---|---|---|---|
| DE | 3428166 | A1 | 2/1986 |
| DE | 10 2008 055 919 | A1 | 3/2009 |

(Continued)

OTHER PUBLICATIONS

An extended European Search Report dated Sep. 18, 2014, issued in the European Patent Application No. 14164146.4-1901, Applicant: GN ReSound A/S, Reference No. P1750EP00 (6pages).

(Continued)

*Primary Examiner* — Huyen D Le
(74) *Attorney, Agent, or Firm* — Vista IP Law Group, LLP

(57) ABSTRACT

A hearing aid includes: a hearing aid housing; a receiver; and a filter; wherein the hearing aid housing comprises an outer surface, a housing opening at the outer surface, and an internal cavity configured for containing the receiver; wherein the filter is insertable into the housing opening and is releasably mounted to the hearing aid housing; and wherein the housing opening is configured to provide sound emitted from the receiver, and wherein the housing opening and the receiver are relatively sized in order to allow for insertion of the receiver through the housing opening into the internal cavity for containment of the receiver in the internal cavity.

13 Claims, 2 Drawing Sheets

(56) References Cited

U.S. PATENT DOCUMENTS

| | | | | | |
|---|---|---|---|---|---|
| 4,679,650 | A | | 7/1987 | Moser et al. | |
| 4,937,876 | A | | 6/1990 | Biermans | |
| 4,972,488 | A | * | 11/1990 | Weiss | H04R 25/654 381/322 |
| 5,099,947 | A | | 3/1992 | Guggenberger et al. | |
| 5,278,360 | A | * | 1/1994 | Carbe | H04R 25/654 181/135 |
| 5,970,157 | A | * | 10/1999 | Yoest | H04R 25/654 381/324 |
| 6,129,174 | A | | 10/2000 | Brown et al. | |
| 6,205,227 | B1 | | 3/2001 | Mahoney et al. | |
| 6,389,143 | B1 | | 5/2002 | Leedom et al. | |
| 6,434,248 | B1 | | 8/2002 | Juneau et al. | |
| 8,098,866 | B2 | | 1/2012 | Gommel et al. | |
| 2002/0027996 | A1 | | 3/2002 | Leedom et al. | |
| 2002/0198437 | A1 | | 12/2002 | Juneau et al. | |
| 2003/0198361 | A1 | | 10/2003 | Heerlein et al. | |
| 2006/0153418 | A1 | | 7/2006 | Van Halteren | |
| 2009/0041261 | A1 | | 2/2009 | Fickweiler et al. | |
| 2009/0046880 | A1 | | 2/2009 | Gunnersen et al. | |
| 2010/0220884 | A1 | | 9/2010 | Aquilina et al. | |
| 2011/0013797 | A1 | | 1/2011 | Cheng et al. | |
| 2012/0163643 | A1 | | 6/2012 | Vestergaard et al. | |

FOREIGN PATENT DOCUMENTS

| | | | |
|---|---|---|---|
| DE | 10 2010 041 695 | A1 | 8/2011 |
| EP | 2 663 097 | A1 | 11/2013 |
| WO | WO 2010147554 | A1 | 12/2010 |
| WO | WO 2012006383 | A1 | 1/2012 |
| WO | WO 2013091682 | A1 | 6/2013 |

OTHER PUBLICATIONS

An Office Communication dated Oct. 30, 2014, issued in the Danish Patent Application No. PA 2014 70201, Applicant: GN ReSound A/S, Reference No. P1750DK00 (7pages).

An Office Communication dated Oct. 21, 2014, issued in the Danish Patent Application No. PA 2014 70199, Applicant: GN ReSound A/S, Reference No. P1596DK00 (6pages).

An Office Communication dated Oct. 24, 2014, issued in the Danish Patent Application No. PA 2014 70200, Applicant: GN ReSound A/S, Reference No. P1597DK00 (6pages).

An Office Communication dated Oct. 31, 2014, issued in the Danish Patent Application No. PA 2014 70202, Applicant: GN ReSound A/S, Reference No. P1751DK00 (7pages).

Second Technical Examination dated May 19, 2015, for corresponding Danish Patent Application No. PA 2014 70199, 3 pages.

Second Technical Examination dated May 20, 2015, for related Danish Patent Application No. PA 2014 70200, 3 pages.

Non-final Office Action dated Aug. 26, 2015 for related U.S. Appl. No. 14/336,471.

Non-final Office Action dated Oct. 2, 2015 for related U.S. Appl. No. 14/331,918.

Non-final Office Action dated Oct. 5, 2015 for rleated U.S. Appl. No. 14/333,397.

Second Technical Examination dated Sep. 16, 2015 for related Danish Patent Application No. PA 2014 70201.

Second Technical Examination dated Sep. 21, 2015 for related Danish Patent Application No. PA 2014 70202.

Notice of Allowance and Fee(s) Due dated Mar. 2, 2016 for related U.S. Appl. No. 14/336,471.

Notice of Allowance and Fee(s) Due dated Mar. 28, 2016 for related U.S. Appl. No. 14/333,397.

* cited by examiner

HEARING AID

RELATED APPLICATION DATA

This application claims priority to, and the benefit of, Danish Patent Application No. PA 2014 70199, filed on Apr. 10, 2014, pending, and European Patent Application No. 14164143.1, filed on Apr. 10, 2014, pending. The entire disclosures of the above applications are expressly incorporated by reference herein.

FIELD

The present disclosure relates to a hearing aid comprising a housing with a receiver/loudspeaker, and a filter, e.g. a cerumen filter, where the housing comprises an outer surface and an internal cavity adapted for containing the receiver/loudspeaker and where the housing further comprises a filter socket wherein the filter is releasably mounted, and where the filter socket is adapted for providing a sound channel extending through the filter between the outer surface and the receiver

BACKGROUND

Hearing aids of the above mentioned kind are known in a lot of different embodiments, where the filter is mostly used as a wax guard with the primary purpose of avoiding ear wax from migrating into the receiver.

Especially in relation to ITE "In The Ear" hearing aids there is an ongoing re-search and development with respect to provide ITE hearing aids with opti-mal sound quality and performance on the one hand, and on the other hand providing a hearing aid being as discrete as possible in the ear of the user. This requires that the components of the hearing aid, such as e.g. the receiver, the filter and its socket, and the electronics used for providing the audible signal are to be arranged in ever smaller spaces, and at the same time providing good sound quality.

SUMMARY

One object is to provide a hearing aid where especially the receiver and the filter socket is easy to dismantle for servicing or exchanging than what is the case with the prior hearing aids.

This is obtained with the hearing aid mentioned in the introduction, and wherein the filter socket and the receiver/loudspeaker are relatively sized in order to allow for insertion or removal of the receiver/loudspeaker through the channel and into or out of the internal cavity respectively, when the filter is dismantled from the filter socket.

In a preferred embodiment the filter comprises a filter holder, and a filter unit, and where the filter holder and the filter unit are adapted for releasably mounting of the filter unit in the filter holder, and the filter holder is attached in the filter socket.

In a further preferred embodiment the receiver/loudspeaker comprises a receiver housing having a first substantially plane side face with a sound opening, and the filter holder comprises a substantially plane bottom plate, and where the filter holder is fastened to the receiver housing, so that the substantially plane bottom plate of the filter holder abuts the substantially plane side face of the receiver housing, and so that the sound opening is aligned with the first opening.

The substantially plane bottom plate may in a further preferred embodiment be fastened to the first substantially plane side face of the receiver housing, so that the receiver and filter holder can be mounted or dismantled as a unit.

In this relation the filter holder may preferably be permanently fastened to the receiver housing by gluing, soldering or welding, and the filter holder releasably attached to the housing with a press fit, a frictional fit, or by means of heat releasable glue.

In a preferred embodiment the hearing aid further comprises a signal processor arranged in the internal cavity of the housing, and being adapted for providing an audio signal to the receiver/loudspeaker via a set of electrical wires extending from the signal processor and to the receiver, and where the length of the electrical wires are so long that the receiver can be pulled out of the internal cavity through the filter socket, without the need of dismantling or stretching the electrical wires.

In a preferred embodiment the receiver housing extends within a substantially uniform rectangular cross section in all planes being parallel to the first substantially plane side face, and the filter holder has a cylindrical outer surface defining an outer diameter, where the diagonal dimension of the substantially uniform cross section of the receiver housing is smaller than the outer diameter of the filter holder.

A hearing aid includes: a hearing aid housing; a receiver; and a filter; wherein the hearing aid housing comprises an outer surface, a housing opening at the outer surface, and an internal cavity configured for containing the receiver; wherein the filter is insertable into the housing opening and is releasably mounted to the hearing aid housing; and wherein the housing opening is configured to provide sound emitted from the receiver, and wherein the housing opening and the receiver are relatively sized in order to allow for insertion of the receiver through the housing opening into the internal cavity for containment of the receiver in the internal cavity.

Optionally, the filter comprises a filter holder and a filter unit, and wherein the filter holder is configured for releasably mounting of the filter unit in the filter holder, and wherein the filter holder is releasably mounted to the hearing aid housing.

Optionally, the receiver comprises a receiver housing having a side face with a sound opening, the filter holder comprising a bottom plate, and wherein the bottom plate of the filter holder abuts the side face of the receiver housing.

Optionally, the bottom plate of the filter holder is fastened to the side face of the receiver housing.

Optionally, the filter holder is permanently fastened to the receiver housing.

Optionally, the filter holder is permanently fastened to the receiver housing by gluing, soldering or welding.

Optionally, the filter holder is releasably mounted to the hearing aid housing with a press fit, a frictional fit, or heat releasable glue.

Optionally, the receiver comprises a receiver housing having a cross section defined at least partially by first two sides that are parallel to each other and second two sides that are perpendicular to the first two sides; wherein the filter holder has an outer surface conforming to the receiver housing and defining an outer opening; and wherein a largest cross sectional dimension of the receiver housing is smaller than the outer opening of the filter holder.

Optionally, the filter holder is configured for releasably mounting of the filter unit in the filter holder by a press fit, or a snap fit.

Optionally, the filter unit is made from a resilient material.

Optionally, the hearing aid further includes a signal processor in the internal cavity of the hearing aid housing, the signal processor configured for providing an audio signal to the receiver via a set of electrical wires extending from the signal processor to the receiver, wherein a length of the electrical wires permits pulling the receiver out of the internal cavity through the housing opening, the length being long enough to allow access to mounting points of the electrical wires without a need of dismantling or stretching the electrical wires.

Optionally, the filter comprises a cerumen filter.

Other and further aspects and features will be evident from reading the following detailed description of the embodiments.

BRIEF DESCRIPTION OF THE DRAWINGS

In the following, the embodiments will be described in greater detail with reference to the enclosed figures. It should be emphasized that the embodiments shown are used for example purposes only and should not be used to limit the scope of the claimed invention.

DETAILED DESCRIPTION OF THE EMBODIMENTS

It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 1:
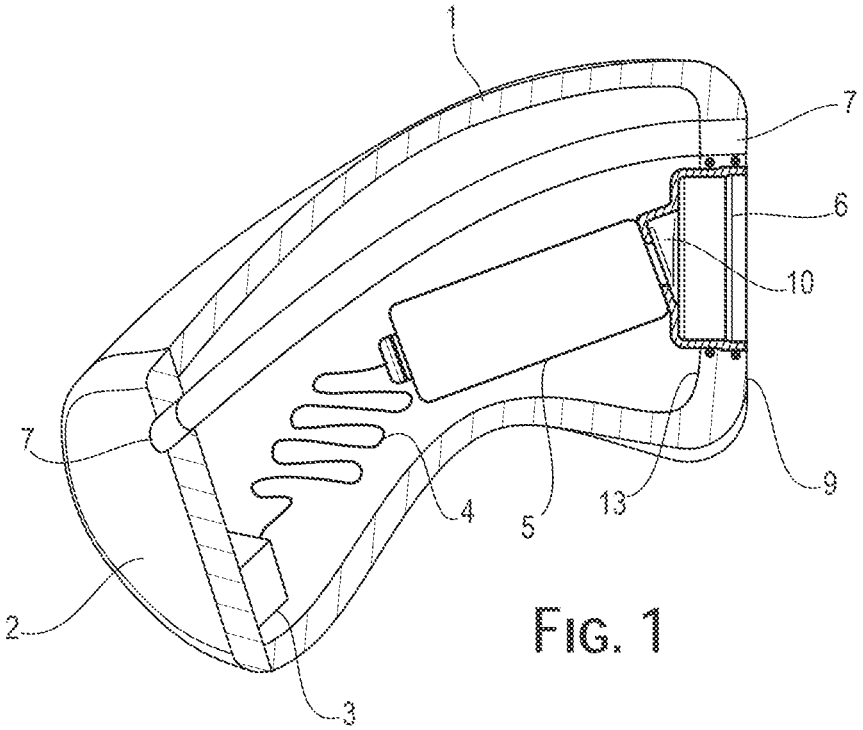
FIG. 1: Is a principle drawing showing a cross section of a hearing aid according to some embodiments.
Figure 4:
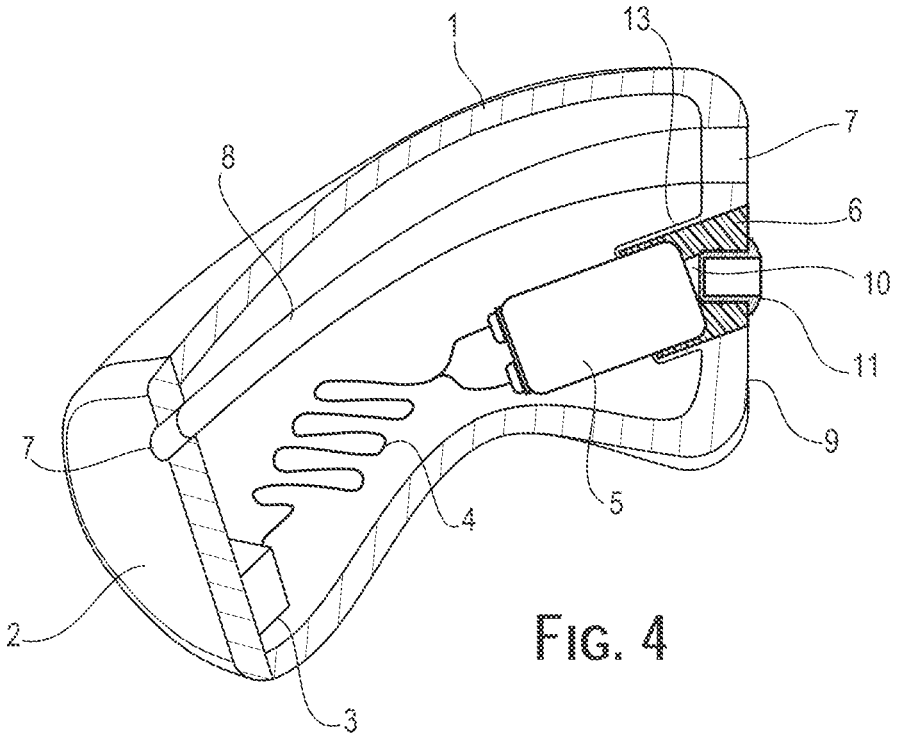
FIG. 4: Is a principle drawing showing a cross section of another embodiment of a hearing aid according to some embodiments.

FIGS. 1 and 4 are principle drawings showing a cross section through hearing aid according to different embodiments, These hearing aids are both of the ITE (in the ear) type being adapted for being positioned completely in the ear of the user, but it will be apparent to the skilled person that one or more features described herein will also be applicable to other types of hearing aids being only partly positioned in the ear of the user.

The hearing aids shown in FIGS. 1 and 4 has a hearing aid housing 1 being closed at one end by a face plate 2, which will normally be the only visible part of the hearing aid, when the hearing aid is positioned in the ear of a user. Thereby the hearing aid housing 1 and the face plate 2 encloses an internal cavity 8.

In hearing aids of the ITE type all functional devices, such as electronics 3, batteries (not shown), wiring 4, a microphone (not shown), a receiver 5 and a cerumen filter holder 6 necessary for the function of the hearing aid have to be positioned in the narrow space provided by the internal cavity 8 in the hearing aid housing 1, and therefore it is important to have a high degree of freedom with respect to positioning each device in an optimal position in order to optimally utilize the space in the hearing aid housing 1.

As it is apparent to the skilled person what functional devices are necessary or nice to have in an ITE hearing aid, then only the electronics 3, the wiring 4, the cerumen filter holder 6 and the receiver 5 is shown in FIGS. 1 and 4. Furthermore FIG. 1 shows the filter holder without a filter unit mounted therein, whereas FIG. 4 shows that a filter unit 11 is mounted in the filter holder 6.

Normally the hearing aid housing 1 further comprises e.g. a pressure equalizing channel 7 extending from the internal cavity 8 and to the outer surface 9 on the hearing aid housing 1. This pressure equalizing channel 7 must be arranged so that it is able to equalize pressure differences between the faceplate 2 on the outside of the hearing aid and the closed space in the ear of the user carrying the hearing aid, and thereby further reducing the freedom to position the functional devices in the internal cavity 8 of the hearing aid housing 1.

In the hearing aid housing 1 a cerumen filter socket 13 is arranged in the end of the hearing aid housing facing the inside of the ear of the user, and the filter holder 6 is mounted in the filter socket 13, having a sound channel 10 extending between the filter holder 6 and the receiver 5.

Figure 2:
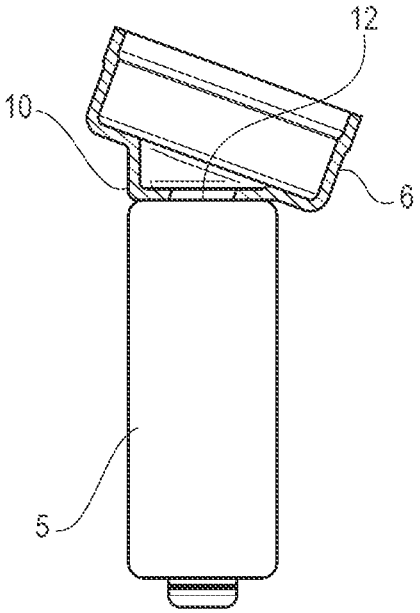
FIG. 2: Shows the filter/receiver assembly shown in FIG. 1.
Figure 3:
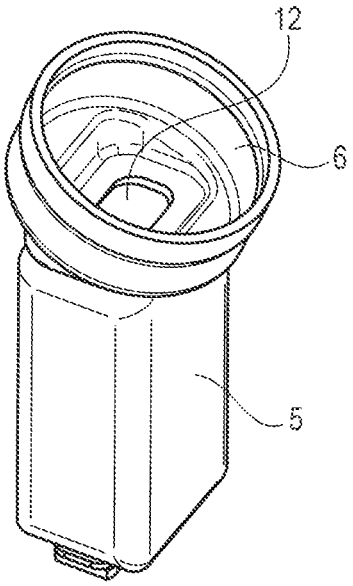
FIG. 3: Is a perspective view of the assembled filter and receiver shown in FIGS. 1 and 2.
Figure 5:
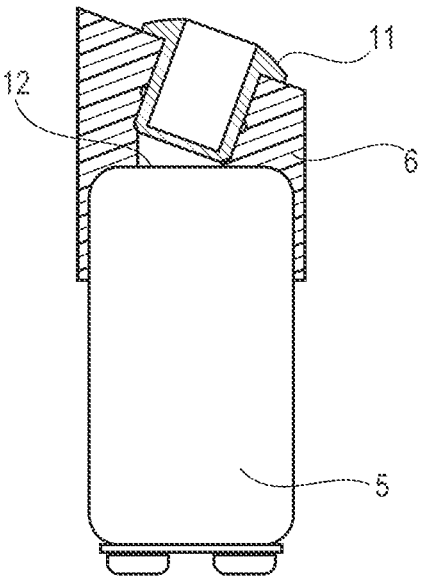
FIG. 5: Shows the filter/receiver assembly shown in FIG. 4.
Figure 6:
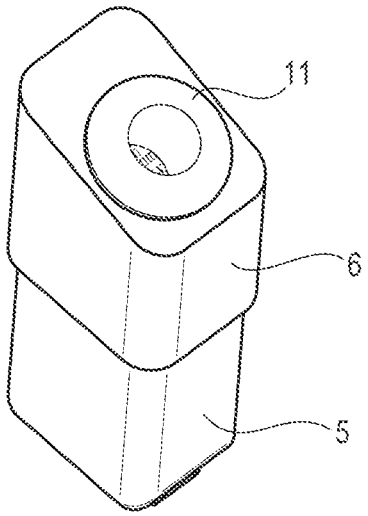
FIG. 6 Is a perspective view of the filter/receiver assembly shown in FIGS. 4 and 5.

The filter holder 6 shown in the figures may e.g. be made from a plastic material, e.g. by injection moulding, or by deep drawing a sheet of metal to the shape shown in FIGS. 1, 2 and 3. In the embodiment shown in FIGS. 1, 2 and 3 the filter holder 6 is fixed to the plane side face 12 of the receiver 5 by welding, gluing or soldering. In the embodiment shown in FIGS. 4, 5 and 6 the filter holder 6 is mounted on the receiver 5 by means of a friction fit, a snap fit or by gluing.

According to the shown embodiments, the filter/filter holder 6 is mounted in the filter socket 13 in the hearing aid housing 1, and the filter socket provides a channel to the internal cavity 8 from the outside of the hearing aid housing 1. According to some embodiments, this passage is made sufficiently large to allow for insertion of the receiver into the internal cavity 8 through the channel.

Furthermore the disclosed embodiments show that the receiver 5 is mounted on the filter holder 6 which is mounted in the filter socket 13. As shown in the figures this provides the option of having the receiver 5 suspended only by the filter holder 6, so that it does not touch any parts of the hearing aid housing 1.

Although some embodiments have been described and shown in detail, the claimed invention is not restricted to them, but may also be embodied in other ways within the scope of the subject matter defined in the following claims. In particular it is to be understood that other embodiments may be utilized and structural and functional modifications may be made without departing from the scope of the claimed invention. As an example of this it will be apparent to the skilled person that one or more features described herein may also be used in relation to hearing aids of another type than the above mentioned ITE type, even though the features have been described with reference to the ITE type hearing aids.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The following items are in accordance with one or more embodiments described herein:

Item 1. A hearing aid comprising a hearing aid housing with a receiver, and a filter, e.g. a cerumen filter, wherein the hearing aid housing comprises an outer surface and an internal cavity adapted for containing the receiver and where the hearing aid housing further comprises a filter socket wherein the filter is releasably mounted, and where the filter socket is adapted for providing a sound channel extending through the filter between the outer surface and the receiver, and wherein the filter socket and the receiver are relatively sized in order to allow for insertion of the receiver through the channel and into the internal cavity, when the filter is dismantled from the filter socket.

Item 2. A hearing aid according to item 1, wherein the filter comprises a filter holder and a filter unit, and wherein the filter holder is adapted for releasably mounting of the filter unit in the filter holder, and the filter holder is attached in the filter socket.

Item 3. A hearing aid according to item 1 or 2, wherein the receiver comprises a receiver housing having a first substantially plane side face with a sound opening, the filter holder comprising a substantially plane bottom plate, and wherein the filter holder is fastened to the receiver housing, in such a way that the substantially plane bottom plate of the filter holder abuts the substantially plane side face of the receiver housing and the sound opening is aligned with the first opening.

Item 4. A hearing aid according to item 3, where the substantially plane bottom plate is fastened to the first substantially plane side face of the receiver housing.

Item 5. A hearing aid according to item 3 or 4, where the filter holder is permanently fastened to the receiver housing by gluing, soldering or welding.

Item 6. A hearing aid according to item 3, 4 or 5, where the filter holder is releasably attached to the filter housing with a press fit, a frictional fit, or by means of heat releasable glue.

Item 7. A hearing aid according to item 1, the hearing aid comprising a signal processor arranged in the internal cavity of the hearing aid housing and being adapted for providing an audio signal to the receiver via a set of electrical wires extending from the signal processor to the receiver, wherein the length of the electrical wires permits pulling the receiver out of the internal cavity through the filter socket, the length being long enough to allow access to the mounting points of the electrical wires without the need of dismantling or stretching the electrical wires.

Item 8. A hearing aid according to item 1, wherein the receiver housing extends within a substantially uniform rectangular cross section in all planes parallel to the first substantially plane side face, the filter holder has an outer surface conforming to the outer shape of the receiver and defining an outer opening, and wherein the diagonal dimension of the substantially uniform cross section of the receiver housing is smaller than the opening of the filter holder.

Item 9. A hearing aid according to one or more of the preceding items, wherein the filter unit is formed as a filter plug adapted for being attached in the filter socket or the filter holder by means of a press fit, or a snap fit.

Item 10. A hearing aid according to item 9, wherein the filter unit comprises a filter housing made from a relatively resilient material.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents, as defined by the claims.

The invention claimed is:

1. A hearing aid comprising:

a hearing aid housing;

a receiver; and a filter;

wherein the hearing aid housing comprises an outer surface, a housing opening at the outer surface, and an internal cavity configured for containing the receiver;

wherein the filter is insertable into the housing opening and is releasably mounted to the hearing aid housing; and wherein the housing opening is configured to provide sound emitted from the receiver, and wherein the housing opening and the receiver are relatively sized in order to allow for insertion of the receiver through the housing opening into the internal cavity for containment of the receiver in the internal cavity.

2. The hearing aid according to claim 1, wherein the filter comprises a filter holder and a filter unit, and wherein the filter holder is configured for releasably mounting of the filter unit in the filter holder, and wherein the filter holder is releasably mounted to the hearing aid housing.

3. The hearing aid according to claim 2, wherein the receiver comprises a receiver housing having a side face with a sound opening, the filter holder comprising a bottom plate, and wherein the bottom plate of the filter holder abuts the side face of the receiver housing.

4. The hearing aid according to claim 3, wherein the bottom plate of the filter holder is fastened to the side face of the receiver housing.

5. The hearing aid according to claim 3, wherein the filter holder is permanently fastened to the receiver housing.

6. The hearing aid according to claim 5, wherein the filter holder is permanently fastened to the receiver housing by gluing, soldering or welding.

7. The hearing aid according to claim 2, wherein the filter holder is releasably mounted to the hearing aid housing with a press fit, a frictional fit, or heat releasable glue.

8. The hearing aid according to claim 2, wherein the receiver comprises a receiver housing having a cross section defined at least partially by first two sides that are parallel to each other and second two sides that are perpendicular to the first two sides;

wherein the filter holder has an outer surface conforming to the receiver housing and defining an outer opening; and wherein a largest cross sectional dimension of the receiver housing is smaller than the outer opening of the filter holder.

9. The hearing aid according to claim 2, wherein the filter holder is configured for releasably mounting of the filter unit in the filter holder by a press fit, or a snap fit.

10. The hearing aid according to claim 2, wherein the filter unit has a side wall that is made from a resilient material.

11. The hearing aid according to claim 1, further comprising a signal processor in the internal cavity of the hearing aid housing, the signal processor configured for providing an audio signal to the receiver via a set of electrical wires extending from the signal processor to the receiver, wherein a length of the electrical wires permits pulling the receiver out of the internal cavity through the housing opening, the length being long enough to allow access to mounting points of the electrical wires without a need of dismantling or stretching the electrical wires.

12. The hearing aid according to claim 1, wherein the filter comprises a cerumen filter.

13. The hearing aid according to claim 1, wherein the filter is configured to be releasably mounted to the hearing aid housing while the filter is at the housing opening.

* * * * *